United States Patent [19]

Schmucker et al.

[11] 4,182,397

[45] Jan. 8, 1980

[54] CONTINUOUS CASTING MOLD AND MEANS FOR SECURING MOLD LINERS THEREIN

[75] Inventors: William A. Schmucker, Cedarburg; Lloyd M. Dings, Jr., Brookfield, both of Wis.

[73] Assignee: Allis-Chalmers Corporation, Milwaukee, Wis.

[21] Appl. No.: 921,471

[22] Filed: Jul. 3, 1978

[51] Int. Cl.[2] ..... B22D 11/124

[52] U.S. Cl. ..... 164/443

[58] Field of Search ..... 164/443, 435

[56] References Cited

U.S. PATENT DOCUMENTS

| | | | |
|---|---|---|---|
| 2,867,018 | 1/1959 | Harter, Jr. et al. | 164/443 X |
| 3,464,485 | 9/1969 | Landgraf et al. | 164/435 |
| 3,866,664 | 2/1975 | Auman et al. | 164/443 |

*Primary Examiner*—Robert D. Baldwin
*Assistant Examiner*—J. Reed Batten, Jr.
*Attorney, Agent, or Firm*—Robert C. Jones

[57] ABSTRACT

An improved continuous casting mold and means for securing the mold liners wherein vertical cooling water passages which in cross-section present a dovetail configuration are machined in the back side of the mold liner plates. The cooling water passages are all of substantially equal dimensions and are equally spaced along the length of the mold liner plates. Corrosive resistant bars having beveled edges to match the dovetail passages are inserted into the water passages. Tapped holes in the bars receive hold down bolts which pass through the bars between the formed water passages and thus do not interfere with uniform heat transfer.

3 Claims, 4 Drawing Figures

CONTINUOUS CASTING MOLD AND MEANS FOR SECURING MOLD LINERS THEREIN

BACKGROUND OF THE INVENTION

The invention relates to an improved liquid cooled mold for the continuous casting of metal and an improved means for securing the liners in the mold.

Liquid metal is continuously cast through a water-cooled mold. The mold consists of liner plates, usually copper, which come into direct contact with the liquid metal being cast. The liner plates usually include cooling water passages and are fastened to a water cooled framework.

The water circulates from the framework through the cooling water passages in the liner plates and back out through the framework, then to heat exchangers and pumps for cooling and recirculation. In this way, heat is removed from the liquid metal being cast. Thus, the liquid metal in contact with the water cooled liner plates solidifies and forms a thin shell. As the cast shape slides along the liner plates, the heat transfer process continues and the solidified shell becomes thicker. In order to have a successful cast, the solidified shell must have sufficient thickness throughout its entire perimeter to support the internal liquid ferrostatic pressure at the point where the cast shape emerges from the mold. This process requires a delicate balance of uniform heat transfer, proper casting speed, selection of correct materials, adequate mold lubrication and good mold design.

The mold liner plates are subject to very severe thermal gradients. The surface temperature of the liner plate in contact with the cast shape varies with location and time. These conditions create extreme stresses in the liner plates which, depending upon design, can cause distortion.

Distortion of the liner plates is detrimental to good uniform heat transfer and, thus, jeopardizes the possibility of successful casting. The liner plates must be machined more frequently, their useful life is shortened and the chances of possible breakout and casting failure are increased. Distortion of the liner plates also causes the molds to leak cooling water. This leakage affects proper heat transfer and, in some cases, creates the possibility of an explosion.

A common method of securing the liner plates to the mold frame consists of drilling and tapping a plurality of blind holes in the liner plate. High strength, corrosion resistant bolts extend through the mold frame and engage the tapped holes in the liner plate. In order to improve the heat transfer, the bottom of the blind holes are machined flat and the bolts are bottomed out against the copper, eliminating the possibility of an air space. The diameter of the bolts is restricted by the spacing of the cooling water passages. The threaded holes in the liner plate are the weak point in the design. The liner plate is subjected to elevated temperatures and the strength of the material is decreased. Copper is the most commonly used liner plate material.

Thermal shock, repeated cycling, and plastic flow are factors which can finally cause the threaded portions of the liner plate to fail.

A method has been used to increase the strength of the connection between the liner plate and bolts. It consists of drilling and tapping oversize holes in the liner plate and then engaging high strength corrosion resistant inserts. The inserts have external threads for engagement in the liner plate and internal threads for engagement with the holding bolts. In this manner, the strength of the connection is increased by increasing the shear area in the threaded portion of the liner plate. This design still has the condition that the heat transfer at the bolts and inserts is different than elsewhere on the liner plate. Also, the use of inserts increases the cost of the liner plates.

Patents which illustrate continuous casting mold of the prior art are U.S. Pat. No. 3,709,286 which teaches the welding of studs to stainless steel strips; and U.S. Pat. No. 3,866,664 teaches the forming of the mold liner with vertical ribs which define with the backup plate a plurality of water passages. Some of the ribs have lateral lips under which metal strips with welded studs are inserted. The studs carried by the metal strips extend through the backup plates for locking the backup plate to the liner. U.S. Pat. No. 3,618,658 teaches utilizing a one-piece or four-piece liner arrangement which is secured to the mold by bolts; U.S. Pat. No. 3,612,158 teaches the forming of the mold wall with inserts of copper which increase the heat conductivity of the mold; U.S. Pat. No. 3,125,786 teaches the utilization of bolts to secure side plates to backing plates to permit longitudinal sliding movement of the side plates relative to the backing plates.

SUMMARY OF THE INVENTION

It is the purpose of this invention to improve the means for securing the mold liner plates to the mold frame, and thus overcome the problems of existing designs.

The invention consists of machining vertical cooling water passages with a special shape in the back side of the mold liner plates. The cooling water passages are all of equal dimension and are equally spaced along the length of the mold liner plate. The passages are machined so that their cross-section forms a dovetail slot facing the back side of the liner plate. Corrosive resistant bars which have beveled edges to match the dovetail slots are inserted into the water passages. The bars which can be made of stainless steel have tapped holes spaced along their length to receive the hold down bolts. After the bars are inserted in the slots, the end of the slots at the bottom edge of the liner plate must be plugged so that the cooling water passages are sealed off when the liner plates are bolted to the mold frame. The top edge of the liner plate is sealed because the slots are stopped short of the top edge. The water passages are located between the casting liner plate and the hold down bolts. Therefore, the bolts do not interfere with uniform heat transfer as in the case of previous designs.

The improved means for securing the liner plates herein disclosed is much stronger because the threaded member is kept cool by the cooling water passage and a higher strength material than the liner plate can be used for the threaded connection.

DESCRIPTION OF THE INVENTION

Figure 1:
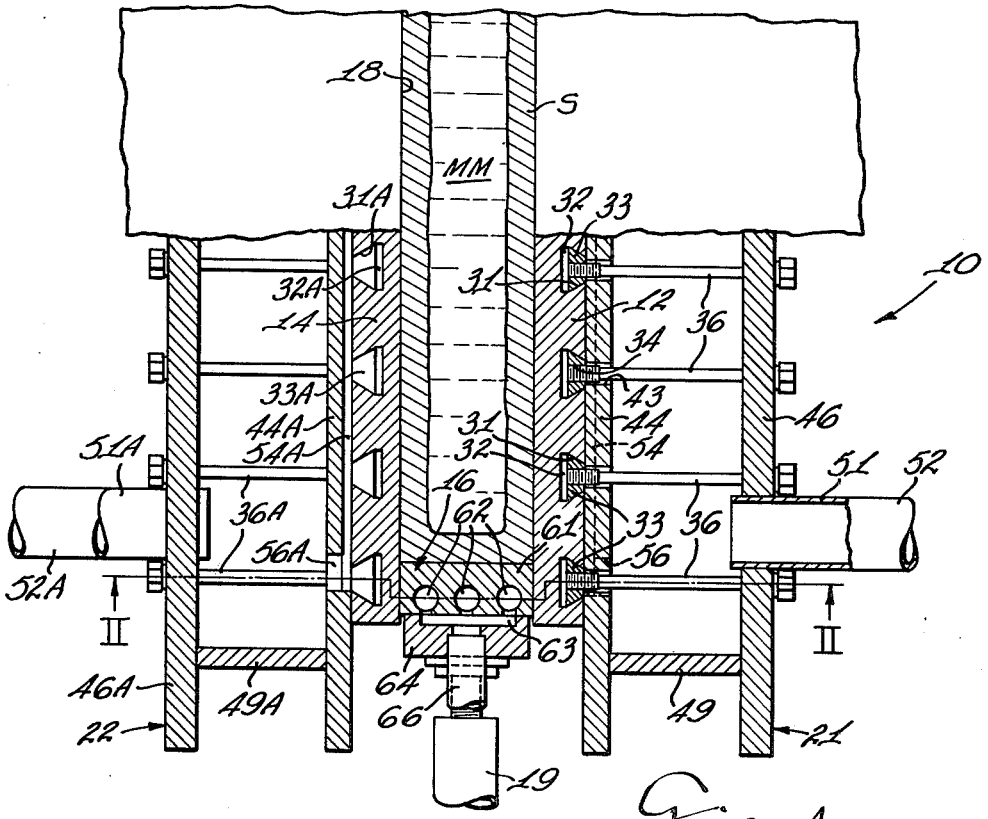
FIG. 1 is a fragmentary plan view partly in section through the continuous casting mold of this invention.

As shown in the drawings, a continuous casting mold 10 which receives molten iron to form it into a continuous plastic slab for high speed casting machines is depicted. The casting mold 10 includes copper side plates 12 and 14 and movable copper end plates 16, one of which is shown in FIG. 1. The end plates are identical and are adapted to be movable between the side plates 12 and 14 to adjust the area of the tube 18 formed by the side plates 12 and 14 and the end plates 16. The end plates 16 are movable toward and away from each other, respectively, by means of jacks 19, the jack associated with the end plate 16 being depicted.

Associated with each of the side plates 12 and 14 are mold plate backup structures 21 and 22 which operate to maintain the associated mold plate in a vertical plane. The entire structure is mounted on a table 23 which, in turn, is carried by the structural steel support 24 of the casting unit. Rollers 26 are a portion of the foot rolls which are attached to the mold.

The tube 18 receives molten metal MM where it is chilled to form an external shell S around the molten metal core MM which makes it possible to progress the slab in a continuous ribbon through the various portions of the machine. To effect the forming of the shell S, heat transfer takes place from the molten metal to the copper side liner and end plates. As is apparent, the temperature is extremely high and the copper side and end plates are subject to very severe thermal gradients and must be cooled. In addition, since the copper liner plates present a considerable surface area to the molten metal MM, the heat tends to warp the liner plates. Thus, they must be backed up by a reinforcing structure and tightly coupled to the backup structure. Distortion of the liner plates is detrimental to good uniform heat transfer and can jeopardize successful casting. In addition, the distorted liner plates must be machined more frequently, thereby reducing the useful life of the liner plates and the chances of possible breakout and casting failure are increased. Distortion of the liner plates also causes the molds to leak cooling water which affects proper heat transfer and in some instances creates the possibility of an explosion.

Various means have been suggested for coupling the mold side plates to the backup structure, as illustrated in the aforementioned patents. One method of securing the liner plates to the mold frame consists of drilling and tapping a plurality of blind holes in the liner plate. High strength, corrosion resistant bolts extend through the mold frame and engage the tapped holes in the liner plate. In order to improve the heat transfer, the bottom of the blind holes are machined flat and the bolts are bottomed out against the copper, eliminating the possibility of an air space. The diameter of the bolts is restricted by the spacing of the cooling water passages. The threaded holes in the liner plate are the weak point in the design. The liner plate is subjected to elevated temperatures and the strength of the material is decreased. Thermal shock, repeated cycling, and plastic flow are factors which can finally cause the threaded portions of the liner plate to fail.

Another method has been used to increase the strength of the connection between the liner plate and bolts. It consists of drilling and tapping oversize holes in the liner plate and then engaging high strength corrosion resistant inserts. The inserts have external threads for engagement in the liner plate and internal threads for engagement with the holding bolts. In this manner, the strength of the connection is increased by increasing the shear area in the threaded portion of the liner plate. This design still has the condition that the heat transfer at the bolts and inserts is different than elsewhere on the liner plate. Also, the use of inserts increases the cost of the liner plates.

Applicants have conceived of an improved means for securing the mold liner plates to the mold frame, and thus overcome the problems of existing designs. The invention consists of machining vertical cooling water passages with a special shape in the back side of the mold liner plates. The cooling water passages are all of equal dimension and are equally spaced along the length of the mold liner plate. The passages are machined so that their cross-section forms a dovetail slot facing the back side of the liner plate. Corrosive resistant bars which have beveled edges to match the dovetail slots are inserted into the water passages. The bars which can be made of stainless steel have tapped holes spaced along their length to receive the hold down bolts. After the bars are inserted in the slots, the end of the slots at the bottom edge of the liner plate must be plugged so that the cooling water passages are sealed off when the liner plates are bolted to the mold frame. The top edge of the liner plate is sealed because the slots are stopped short of the top edge. The water passages are located between the casting liner plate and the hold down bolts. Therefore, the bolts do not interfere with uniform heat transfer as in the case of previous designs.

As shown in the drawings, the liner plates 12 and 14 as well as their associated backup structures 21 and 22, respectively, are similar and a description of the liner plate 12 and its backup structure 21 will apply to the liner plate 14 and its backup structure 22 and the parts are identified with the same reference number followed by the suffix "A". The liner plate 12 is provided with a plurality of vertical passages 31. The passages in cross-section are dovetail having an internal rectangular portion 32 which serve as cooling water passages. The dovetail passages 31 as well as the rectangular cooling water passages 32 are of equal dimensions and are equally spaced along the length of the mold liner plate 12. Metallic bars 33 of a corrosive resistant material having beveled edges which are machined to match the dovetail passages 31 are inserted into the passages. Thus, the bevel edge bars 33 define the fourth side of the rectangular cooling water passages 32 to define a water passage which is substantially leak proof. The bars 33 have a series of tapped holes 34 spaced along their length and each receive a hold down bolt 36. With the bar 33 inserted in the dovetailed passages, the lower ends 37 of the passages at the bottom edge 38 of the liner plate 12 are plugged with dovetailed plugs as at 39 so that the cooling water passages 32 are sealed when the liner plate 12 is bolted to the backup frame 21. The top edge 41 of the liner plate 12 is sealed automatically because the passages 31–32 when formed are stopped short of the top edge 41. As can be seen, the water passages 32 are located between the dovetailed hold down bars 33 and a section of the liner plate 12 which is adjacent the tube 18 and thus do not interfere with uniform heat transfer.

Figure 2:
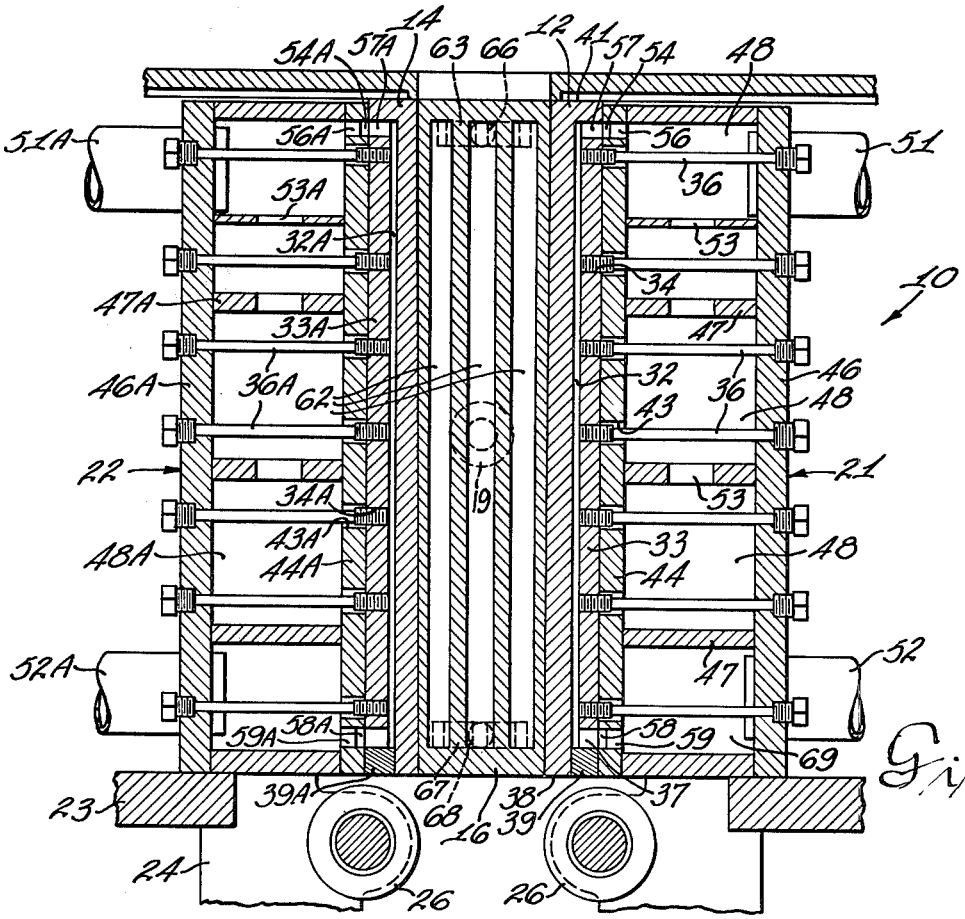
FIG. 2 is a view in vertical section taken in a plane represented by the line II—II in FIG. 1.
Figure 3:
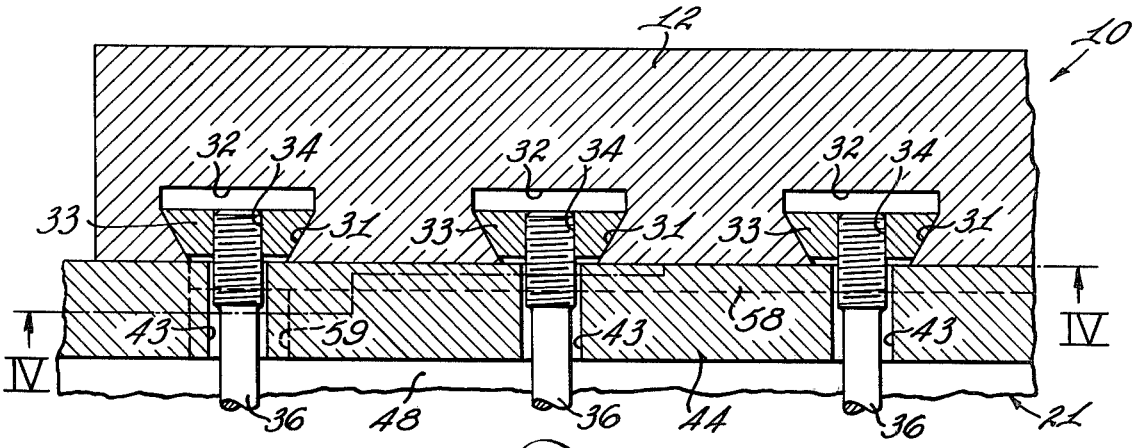
FIG. 3 is an enlarged fragmentary view of a portion of the mold plate and backup plate showing the arrangement of some of the fasteners; and, FIG. 4 is an enlarged sectional view taken in a plane represented by the line IV—IV in FIG. 3 showing cooling passageway arrangements.

The bolts 36 extend through openings 43 provided in the inner wall 44 of the backup structure 21. To provide a cooling water reservoir for effecting heat transfer from the inner wall 44, the backup structure is provided with an outer wall 46, as shown in FIGS. 1 and 2. The outer wall 46 is spaced apart from the inner wall 44 by webs 47 which form a plurality of compartments 48. End walls 49 at each end of the backup structure 21 complete the internal cooling water reservoirs.

Figure 4:
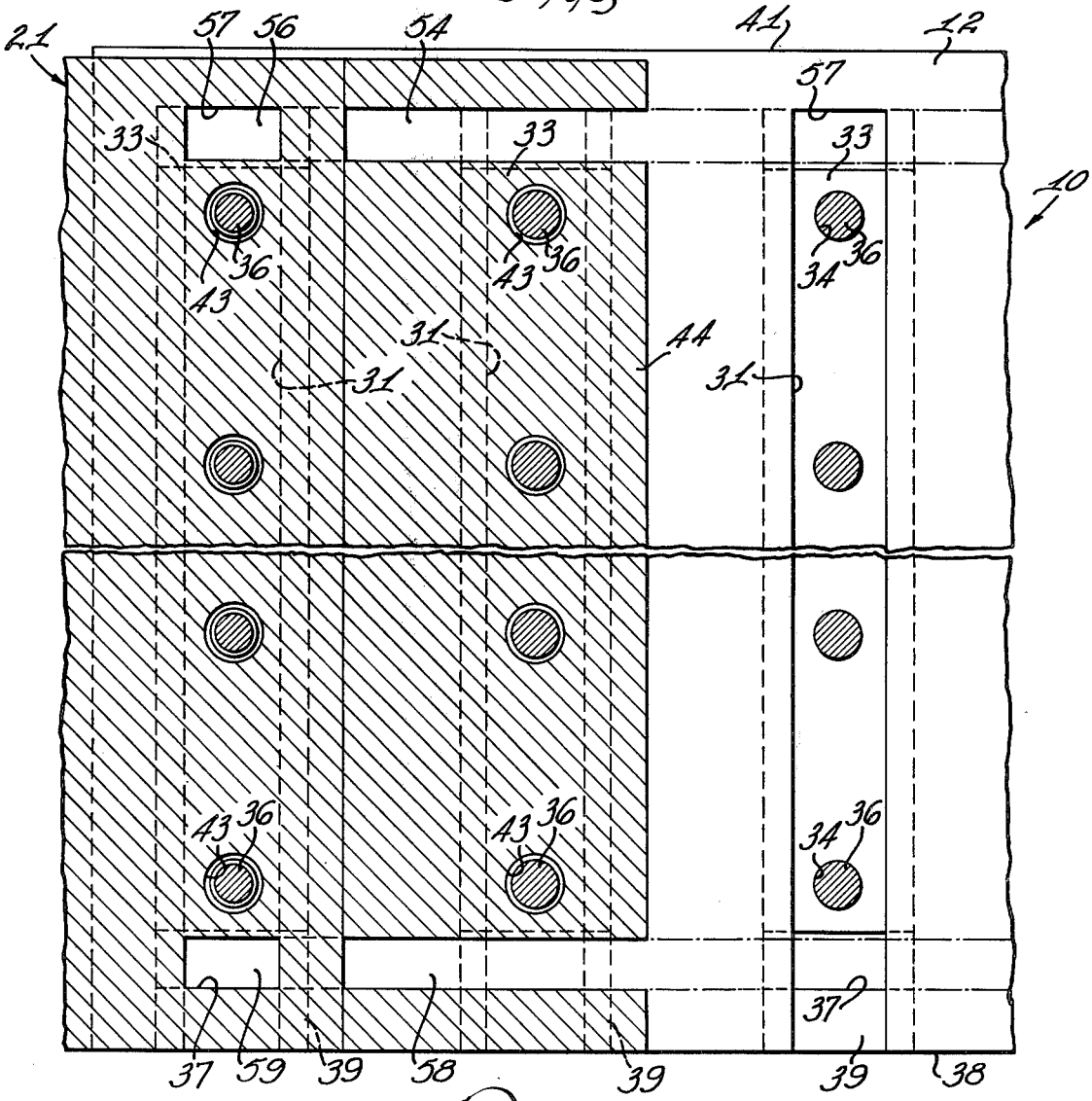

To provide for a circulation of cooling water to the cooling passages 32, there is provided an upper water inlet pipe 51 and a lower outlet pipe 52. The pipe 51 communicates with the uppermost of the chambers 48 while the pipe 52 is in communication with the bottom chamber 69. Openings 53 formed in the webs 47 provide for filling the chambers or compartments 48. Thus, water flowing into the uppermost chamber 48 through pipe 51 will flow downwardly into the chamber below through the communicating openings 53 until the chambers are filled. With all of the chambers 48 filled with cooling water, the water will flow into an upper longitudinally extending passage 54 formed in the upper portion of the surface of the inner wall 44 that is in engagement with the liner plate 12 via a communicating port 56. The longitudinally extending passage 54 (FIGS. 2 and 4) is arranged so as to communicate with the plurality of spaced apart water cooling passages 32 via the space 57 formed by stopping the hold down bars 33 short of the length of the dovetail passage 31.

The lower or bottom ends of the water cooling passages 32 are all in communication with a longitudinally extending passage 58 formed in the lower portion of the inner wall 44. The longitudinal passage 58 communicates with the lowermost chamber 69 via a port 59 and with the water cooling passages 32 via the connecting spaces 37 above the plugs 39. Thus, a continuous circulation of cooling water is supplied to the vertical water passages 32.

The end plates as exemplified by the end plate 16 are also provided with circulating water cooling passages. To this purpose, the inner wall 61 is formed with a plurality of vertical passageways 62 which are plugged at both the top and lower ends. At the top end the passages 62 communicate with a passage 63 formed in the inner surface of the outer plate 64 via transverse communicating passages that extend from each of the vertical passages 62. Cooling water is supplied to the passage 63 via an inlet pipe 66. The lower ends of the passages 62 communicate with a lower transverse passage 67 which in turn communicates with an outlet pipe 68.

From the foregoing description of the invention, it is apparent that an improved means has been provided for securing liner plates to backup structure which provide much stronger and more dependable apparatus. The threaded ends of the bolts 36 and the hold down bars are kept cooler and a higher strength material than the liner plate can be utilized for the connection. The arrangement set forth also prevents mold cooling water leakage into the tube which receives the molten metal to minimize the possibility of explosions.

The embodiments of the invention in which an exclusive property or privilege is claimed are defined as follows:

1. In a continuous casting mold which includes a mold liner, said casting mold having a backup structure to which said mold liner is secured in abutting relationship, the improvement of a plurality of vertical cooling water passages formed in the surface of said liner which abuts said backup structure;

a plurality of holding bar members each engageable within an associated vertical cooling water passage, each said holding bar member including tapped holes extending completely therethrough, said holding bar members when in operating position serving as a vertical side for said vertical cooling water passages;

a plurality of securing bolts extending through the said backup structure into threaded holding connection with said tapped holes of said bar members, said threaded connection being effected adjacent to said water cooling passages; and, water inlet and outlet means communicating with all of said water passages to provide a circulation of cooling water in said passages;

whereby heat is uniformly transferred and the threaded ends of the securing bolts associated with said liner are cooled without interfering with the uniform heat transfer from said liner.

2. A continuous casting mold according to claim 1 wherein said water cooling passages in cross-section present a dovetail configuration; and, said holding bar members are formed with beveled sides to mate with the dovetail configuration of said water cooling passages to close said water cooling passages and transmit the force of said bolts to said mold liner to firmly secure said mold liner to said backup structure.

3. A continuous casting mold according to claim 2 wherein said dovetailed water cooling passages and said associated mating beveled bar members are constructed and arranged so that there is a space between said bar members and the backup structure to permit the flow of cooling water through the space; and, the openings in the backup structure through which said secured bolts extend are of a size to provide clearance around said bolts for the flow of cooling water.

* * * * *